US011578554B2

(12) United States Patent
Burckhard et al.

(10) Patent No.: US 11,578,554 B2
(45) Date of Patent: Feb. 14, 2023

(54) WELL PACKERS

(71) Applicant: Halliburton Energy Services, Inc., Houston, TX (US)

(72) Inventors: Shane R. Burckhard, Sanger, TX (US); Michael D. Ezell, Cassville, MO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/353,347

(22) Filed: Jun. 21, 2021

(65) Prior Publication Data

US 2021/0310328 A1 Oct. 7, 2021

Related U.S. Application Data

(62) Division of application No. 15/776,534, filed as application No. PCT/US2016/054863 on Sep. 30, 2016, now Pat. No. 11,066,897.

(51) Int. Cl.

| | |
|---|---|
| ***E21B 33/128*** | (2006.01) |
| ***E21B 33/12*** | (2006.01) |
| ***E21B 33/129*** | (2006.01) |
| ***E21B 23/06*** | (2006.01) |

(52) U.S. Cl.

CPC ..... *E21B 33/128* (2013.01); *E21B 23/06* (2013.01); *E21B 33/1208* (2013.01); *E21B 33/1216* (2013.01); *E21B 33/1293* (2013.01)

(58) Field of Classification Search

CPC ..... E21B 33/1208; E21B 33/128

See application file for complete search history.

(56) References Cited

U.S. PATENT DOCUMENTS

| | | | | |
|---|---|---|---|---|
| 2,241,532 | A * | 5/1941 | Barnes | E21B 33/128 166/134 |
| 2,241,561 | A | 5/1941 | Spencer | |
| 3,306,362 | A | 2/1967 | Urbanosky | |
| 3,776,561 | A * | 12/1973 | Haney | E21B 33/1208 277/340 |
| 4,753,444 | A | 6/1988 | Jackson et al. | |
| 5,311,938 | A | 5/1994 | Hendrickson et al. | |
| 5,603,511 | A | 2/1997 | Keyser, Jr. et al. | |

(Continued)

FOREIGN PATENT DOCUMENTS

EP 3012398 A2 11/2017

OTHER PUBLICATIONS

Canadian examination report issued in corresponding CA applicaton No. 3,081,047 dated Jun. 8, 2021.

(Continued)

*Primary Examiner* — Kenneth L Thompson

(74) *Attorney, Agent, or Firm* — Conley Rose, P.C.; Rodney B. Carroll

(57) ABSTRACT

A packer for wells can include a body having a tubular shape, a sealing element having an upward end and a downward end and disposed around the body. The packer also includes a first prop upward of the sealing element, and a second prop downward of the sealing element. The first prop is configured to wedge under the upward end of the sealing element and the second prop is configured to wedge under the downward end of the sealing element to push the sealing element outward at both the upward end and the downward end.

23 Claims, 3 Drawing Sheets

(56) References Cited

U.S. PATENT DOCUMENTS

| | | | | |
|---|---|---|---|---|
| 6,102,117 | A | 8/2000 | Swor et al. | |
| 6,478,093 | B1 | 11/2002 | Hilts et al. | |
| 6,705,615 | B2 | 3/2004 | Milberger et al. | |
| 7,552,768 | B2 * | 6/2009 | O'Brien | E21B 33/1208 166/179 |
| 8,397,802 | B2 * | 3/2013 | Lembcke | E21B 33/1293 166/138 |
| 9,303,483 | B2 * | 4/2016 | Chalker | E21B 33/13 |
| 9,506,315 | B2 * | 11/2016 | Connelly | E21B 33/128 |
| 9,995,111 | B2 | 6/2018 | Hughes et al. | |
| 11,066,897 | B2 * | 7/2021 | Burckhard | E21B 33/1208 |
| 2005/0161232 | A1 | 7/2005 | Patel et al. | |
| 2009/0277651 | A1 | 11/2009 | Kilgore | |
| 2014/0332239 | A1 | 11/2014 | Porta | |
| 2015/0300122 | A1 | 10/2015 | George et al. | |
| 2016/0258244 | A1 | 9/2016 | Connelly | |
| 2019/0055808 | A1 | 2/2019 | Krueger | |

OTHER PUBLICATIONS

International Search Report of the Korean Intellectual Property Office, as ISA, dated Jun. 26, 2017, in corresponding International Patent Application No. PCT/US2016/054863, 10 pages.

Search Report of the Netherlands Patent Office, dated Mar. 15, 2018, issued in corresponding NL Patent Application No. 1042545, 10 pages.

Singapore Written Opinion issued in corresponding SG application No. 11201900832U, dated Jul. 15, 2020, 7 pages.

* cited by examiner

WELL PACKERS

CROSS-REFERENCE TO RELATED APPLICATIONS

The present U.S. patent application is a divisional of co-pending U.S. patent application Ser. No. 15/776,534, filed May 16, 2018, which is a U.S. National Phase of International Application PCT/US2016/054863, filed Sep. 30, 2016, both of which are incorporated herein by reference.

BACKGROUND

1. Field

The present disclosure relates to well drilling and exploration, more specifically to well packers.

2. Description of Related Art

Certain well packers are used to create gas tight seals, e.g., in between sections of production casing. Traditional designs of packers can utilize a compression seal to squeeze and deform the seal outwardly. Certain designs utilize a single prop element which wedges under a portion of the sealing element to force the seal outward. The benefits of the single prop element are limited to one side of the packer. Consequently pressure reversals from one side to the other of the sealing element result in some loss of energy stored in the seal.

Such conventional methods and systems have generally been considered satisfactory for their intended purpose. However, there is still a need in the art for improved well packers. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
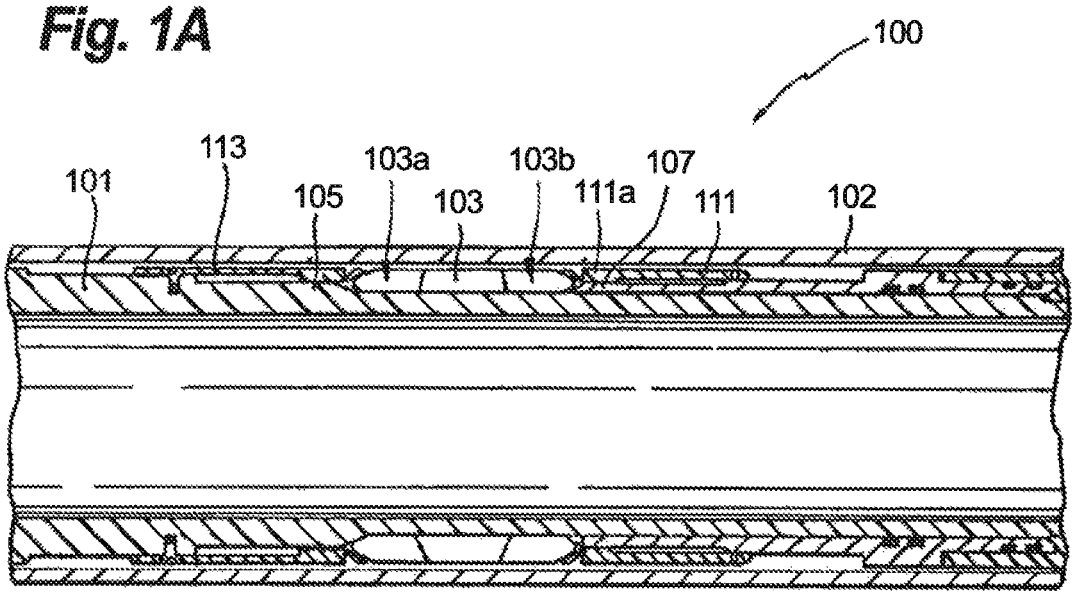
FIG. 1A is a cross-sectional elevation view of an embodiment of a packer in accordance with this disclosure, shown in a retracted state.

Reference will now be made to the drawings wherein like reference numerals identify similar structural features or aspects of the subject disclosure. For purposes of explanation and illustration, and not limitation, an illustrative view of an embodiment of a packer in accordance with the disclosure is shown in FIG. 1A and is designated generally by reference character 100. Other embodiments and/or aspects of this disclosure are shown in FIGS. 1B and 1C-2B. For convenience, "upward" and "upper" refer generally to the left side of the figures while "downward" and "lower" refer generally to the right side. Embodiments of the systems and methods described herein can be used to more effectively seal zones of a wellbore by providing a packer that uses two props (e.g., a fixed prop and a movable prop), to seal off the wellbore.

Figure 1B:
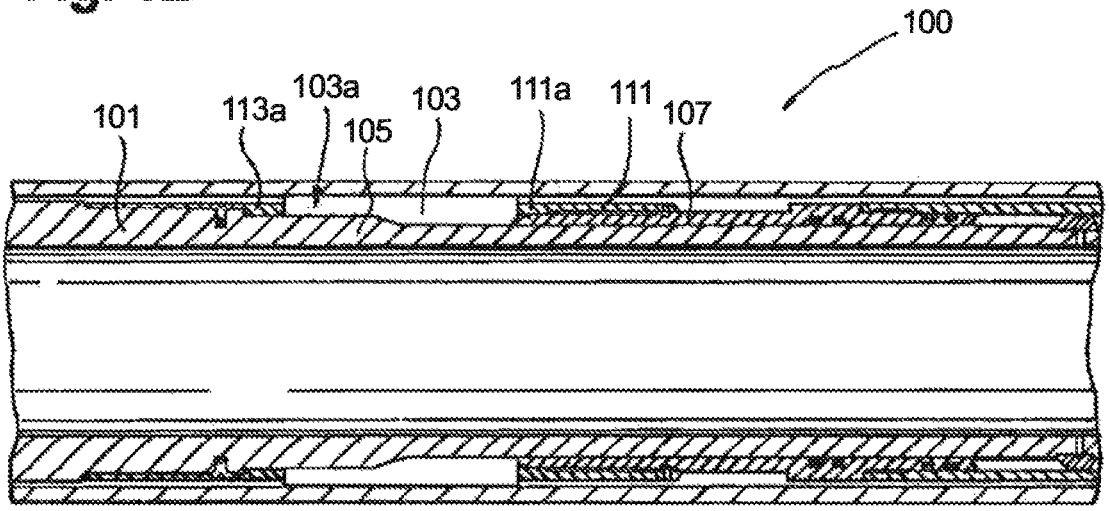
FIG. 1B is a cross-sectional elevation view of the packer of FIG. 1A, shown in a partially deployed state wherein the sealing element is pushed up on the upper prop.
Figure 1C:
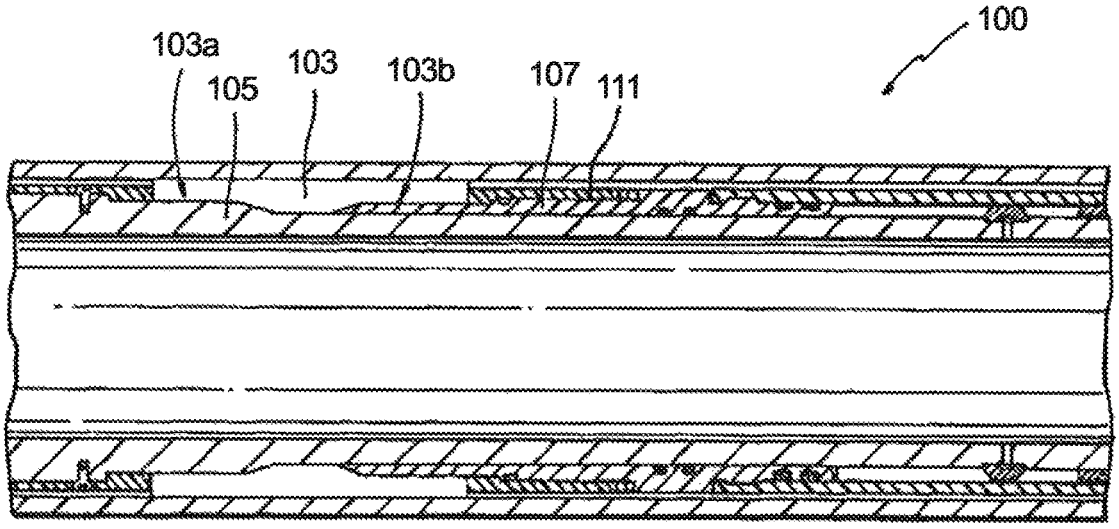
FIG. 1C is a cross-sectional elevation view of the packer of FIG. 1A, shown in a fully deployed state wherein the lower prop is wedged under the sealing element.

Referring to FIG. 1A, a packer 100 for wells (e.g., wellbore 102 or casing thereof) can include a body 101 having a tubular shape, a sealing element 103 having an upward end 103*a* and a downward end 103*b* and disposed around the body 101. The packer 100 also includes a fixed first prop 105 formed on the body 101 upward of the sealing element 103 and a movable second prop 107 mounted on the body 101 downward of the sealing element 103. The second prop 107 can slide toward the first prop 105 when the packer 100 is actuated to push the sealing element 103 onto the first prop 105. This causes the first prop 105 to wedge under the upward end 103*a* of the sealing element 103 as shown in FIG. 1B. The sliding of the second prop 107 also causes it to wedge under the downward end 103*b* of the sealing element 103 to push the sealing element 103 outward (i.e., radially toward the wellbore 102 or casing thereof). This provides significantly improved sealing for the well in that the sealing element 103 is propped or pressed against the well at both the upward end 103*a* and the downward end 103*b* as shown in FIG. 1C. For example, in some embodiments the first and second props 105, 107 can be ramp shaped or sloping toward the sealing element 103 to facilitate wedging under the upward end 103*a* downward end 103*b* of the sealing element 103.

As shown, the first prop 105 can be formed as part of the body 101 or otherwise fixed relative to the body in certain embodiments, while the second prop 107 can be movable relative to the body 101 to slide upward and wedge under the sealing element 103. One having ordinary skill in the art appreciates that the second prop 107 and the first prop 105 can also be reversed in function as described herein. For example, it is contemplated that the first prop 105 can move relative to the body 101 and the second prop 107 is formed as part of the body 101 (or otherwise fixed relative to the body). In either case, having dual props allows the sealing element 103 to provide greater sealing pressure compared to single prop packers for substantially the same amount of setting or actuating force as single prop packers.

In certain embodiments, referring to FIG. 1B, the second prop 107 can be configured (i.e., sized, shaped, positioned, and/or connected) to push the sealing element 103 up onto the first prop 105 when wedging under the sealing element 103. For example, the second prop 107 can be connected (e.g., pinned) to the body 101 or any other suitable fixed member and then a pressure or other force can be applied to the packer 100 to remove the connection (e.g., shear the pin) fixing the second prop 107 relative to the body 101.

In certain embodiments, the packer 100 can include a lower cover sleeve 111 that is slidably disposed around the second prop 107. The lower cover sleeve 111 can have a lower pushing face 111*a* configured to push the sealing element 103 upward to wedge the first prop 105 under the upward end of the sealing element 103. In this regard, the lower cover sleeve 111 and/or the second prop 107 can be breakably pinned together and work in conjunction to force the sealing element 103 upward before the second prop 107 wedges under the sealing element 103. As shown in FIG. 1B, the lower cover sleeve 111 prevents the second prop 107 from wedging underneath the sealing element 103 while the lower cover sleeve 111 is pinned to the second prop 107.

In certain embodiments, the packer 100 can include an upper cover sleeve 113 slidably disposed around the first prop 105. The upper cover sleeve 113 can include an upper pushing face 113*a* (see FIG. 1B) configured to limit upward movement of the sealing element 103 after the first prop 105 is wedged under the upper end 103*a* of the sealing element 103, as shown in FIG. 1B.

Referring to FIG. 1C, after the sealing element 103 is pushed up on the first prop 105, continued force can shear the connection (e.g., a pin) fixing the lower cover sleeve 111 to the second prop 107. The second prop 107 can then move upward and under the downward end 103*a* of the sealing element 103. Any other suitable sequence of events and/or other packer components are contemplated herein to be used with packer 100.

Figure 2A:
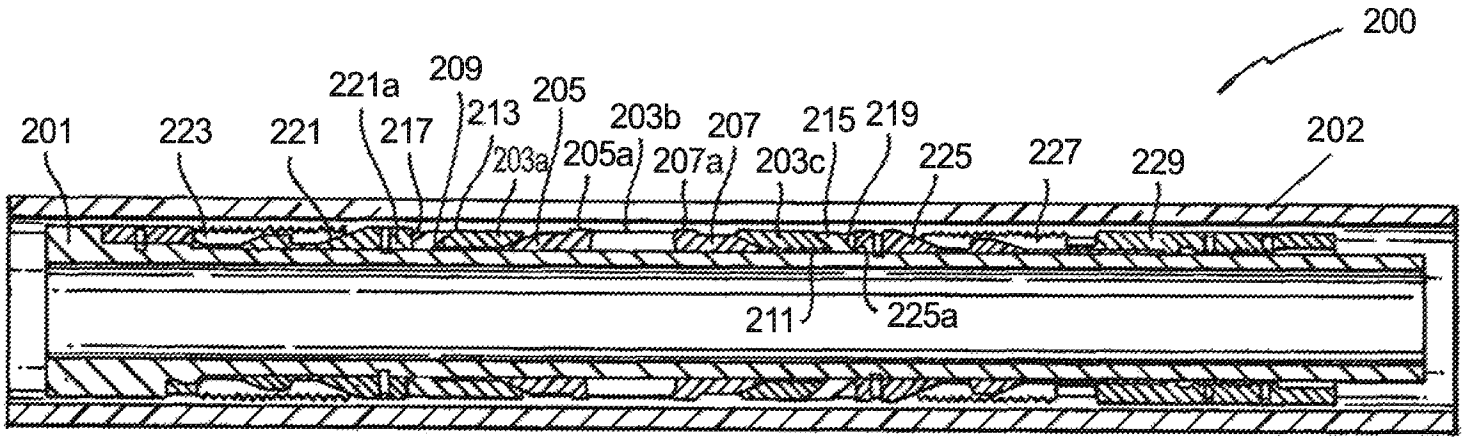
FIG. 2A is a cross-sectional elevation view of an embodiment of a packer in accordance with this disclosure, shown in a retracted state.

In certain embodiments, e.g., as shown in FIG. 2A, a packer 200 for a well includes a body 201 having a tubular shape and dual props where both props are movable. In such an embodiment, there can be multiple sealing elements, e.g., an upper sealing element 203*a*, a middle sealing element 203*b*, and a lower sealing element 203*c* disposed around the body 201. A first prop 205 is disposed upward of the middle sealing element 203*b* and downward of the upper sealing element 203*a*. A second prop 207 is disposed downward of the middle sealing 203*b* element and upward of the lower sealing element 203*c*.

The lower sealing element 203*c* can slide toward the upper sealing element 203*a* when the packer 200 is actuated, pushing the first prop 205 to wedge under the upper sealing element 203*a* to thereby push the upper sealing element 203*a* outward (i.e., toward wellbore 202). The actuation of the packer also pushes the second prop 207 to wedge under the lower sealing element 203*c* to thereby push the lower sealing element 203*c* outward. This can be seen in FIG. 2B.

Figure 2B:
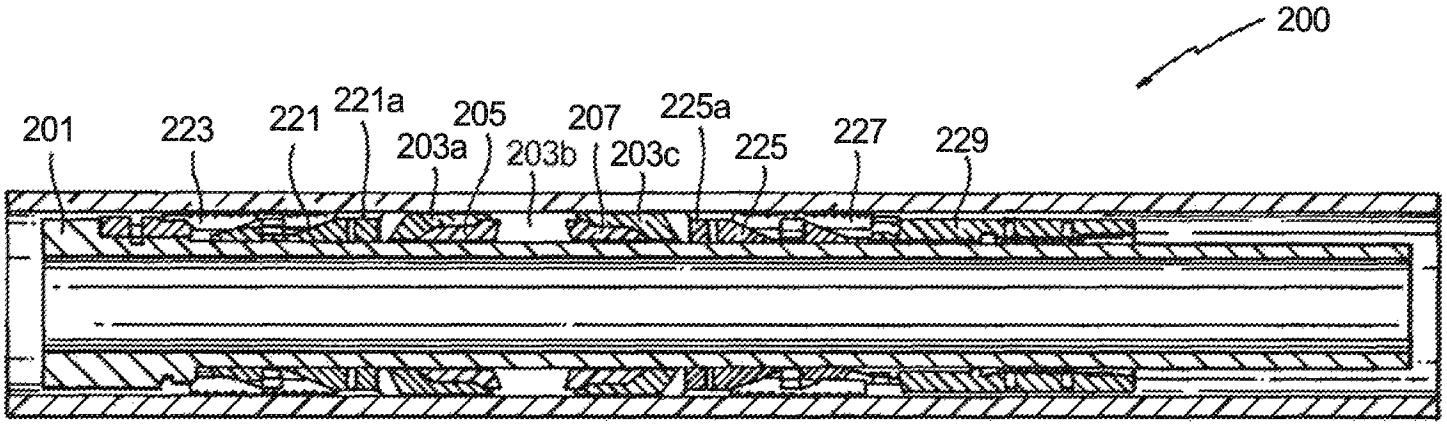
FIG. 2B is a cross-sectional elevation view of the packer of FIG. 1A, shown in a deployed state wherein the upper prop is wedged under the upper sealing element and the lower prop is wedged under the lower sealing element, wherein the middle sealing element is compressed between the upper and lower props.

Referring still to FIG. 2B, one or both of the first and second props 205, 207 can compress the middle sealing element 203*b* to outwardly expand the middle sealing element 203*b*. For example, the first prop 205 can include a flat downward surface 205*a*. The second prop 207 can include a flat upward surface 207*a*. Actuation of the packer 200 moves the first and second props 205, 207 toward each other, causing the flat downward surface 205*a* and the flat upward surface 207*a* to compress the middle sealing element 203*b* to outwardly expand the middle sealing element 203*b*.

The packer 200 can include an upper anti-extrusion ring, indicated generally at 209, disposed adjacent and upward of the upper sealing element 203*a* and configured to resist and/or prevent upper axial extrusion of the upper sealing element 203*a*. In certain embodiments, the packer 200 can include a lower anti-extrusion ring, indicated generally at 211, disposed adjacent and downward of the lower sealing element 203*c* and configured to resist and/or prevent lower axial extrusion of the lower sealing element 203*c*. The upper and/or lower anti-extrusion ring 209, 211 can have any suitable design and can include or be composed of, for example, polyether ether ketone (PEEK), polytetrafluoroethylene (e.g., TEFLON), a perfluoroelastomer (e.g., KALREZ), a metal, and/or any other suitable rigid or semi-rigid material as appreciated by those skilled in the art.

In certain embodiments, the first and/or second prop 205, 207 can include or be composed of a metal and/or any other suitable material. The sealing elements 203*a*, 203*b*, 203*c* (and 103 from FIG. 1A) can include or be composed of an elastic material and/or any other suitable material.

The packer 200 can include an upper and/or lower backup ring, indicated generally at 213, 215, disposed outwardly adjacent the upper sealing element 203*a* and/or lower sealing element 203*c*, respectively. The upper and/or lower backup ring 213, 215 are generally known in the art may include or be composed of at least one of Teflon or wire mesh and/or any other suitable material. The upper and lower backup rings 213, 215, if utilized, are configured to support and contain the pushed and hence energized upper and lower sealing element 203*a*, 203*c* and to form an anti-extrusion barrier between the wellbore 202 and the body 201.

In certain embodiments, the packer 200 can include an upper and/or lower support shoe 217, 219 disposed outwardly adjacent the upper and/or lower backup ring 213, 215, respectively. In certain embodiments, the upper and/or lower support shoe 217, 219 can include or be composed of metal and/or any other suitable material. The upper and lower support shoes 217, 219, if utilized, are used to support and contain the energized upper and lower sealing element 203*a*, 203*c* and to form an anti-extrusion barrier between the wellbore 202 and the body 201.

In certain embodiments where backup rings 213, 215 are used in conjunction with the support shoes 217, 219, the backup rings 213, 215 can be made of a material that is more easily deployed/deformed than, e.g., Teflon or wire meshing. When the sealing element pushes against backup rings 213, 215 (e.g., due to the increased temperature of a high temperature/pressure environment) during the setting process, the backup rings will deploy/deform from being pushed by the energized sealing element 203*a*, 203*c* to deploy and/or change the shape of the support rings 217 and 219.

The packer 200 can include a lower cone 225 slidably disposed around the body 201 and a lower slip 227. In certain embodiments, the lower cone 225 can include or have a ramp shape on an outer diameter thereof. As shown in FIG. 2A, the lower cone 225 can be breakably pinned to be fixed relative to the body 201 until a suitable shearing force is applied. When a suitable shearing force is applied (e.g., via lower actuator 229 or any other suitable force), the lower cone 225 can move upward to push (e.g., via lower pushing surface 225*a*) against the lower sealing element 203*c*, the lower anti-extrusion ring 211, or any other suitable component.

Also as shown, the lower slip 227 can be configured to move upward relative to the lower cone 225 to be outwardly deployed via any suitable application of force (e.g., via lower actuator 229). It is appreciated by those with ordinary skilled in the art that the lower slip 227 can be pushed up over the lower cone 225 by the lower actuator 229 before or while the lower actuator 229 pushes on the lower cone 225 to deploy the lower slip 227 to fix the packer 200 within the well. Regardless, the lower actuator 229 can advance upward and apply force to the lower cone 225 and the components upward of the lower cone 225 through the lower cone 225.

The packer 200 can include an upper cone 221 slidably disposed around the body 201 and an upper slip 223. In certain embodiments, the upper cone 221 can include or have a ramp shape on an outer diameter thereof. As shown in FIG. 2A, the upper cone 221 can be breakably pinned to be fixed relative to the body 201 until a suitable shearing force is applied (e.g., via lower actuator 229 or any other suitable force). When a suitable shearing force is applied (e.g., via lower actuator 229 or any other suitable force), the upper cone 221 can move upward to outwardly deploy the upper slip 223 to grip the wellbore and/or well casing, as shown in FIG. 2B.

The upper cone 221 can include an upper pushing face 221*a* configured to limit upward movement of the upper sealing element 203*a* and/or any other associated component. For example, as the sealing elements 203*a*, 203*b*, 203*c* and props 205, 207 are pushed upward by the pushing face 225*a* of the lower cone 225, the upper sealing element 203*a* (and/or the upper backup ring 213/support shoe 217) can push against pushing face 221*a* of the upper cone 221 to shear the connection between the upper cone 221 and the body 201 and push the upper cone 221 upward to deploy the upward slip 223. As shown in FIG. 2B, after the upper cone 221 has fully deployed the upper slip 223, the upper cone 221 can be prevented from moving further upward, thereby blocking (with pushing face 221*a*) further upward movement of the sealing elements 203*a*, 203*b*, 203*c* and props 205, 207, and/or other associated components (e.g., backup ring 213, 215 and/or support shoes 217, 219).

This resistance to further upward motion causes the sealing elements 203*a*, 203*b*, 203*c* and props 205, 207 to compress together between the upper cone 221 and the lower cone 225. As a result, the upper prop 205 is pushed to wedge under the upper sealing element 203*a* and the lower sealing element 203*c* is pushed up onto the lower prop 207. This creates a double-propped seal which can maintain a gas tight seal in conditions where pressure is applied to either side of the packer and/or pressure reversals occur.

Additionally, the middle sealing element 203*b* can be compressed between the upper prop 205 and the lower prop 207 to deform the middle sealing element outward. This can provide an additional seal. However, it is contemplated that the middle seal 203*b* need not be included and that the upper and lower props 205, 207 can be formed or joined together or otherwise contact each other in any other suitable manner.

While the packers 100, 200 as described above include only a single sealing assembly, it is contemplated that any number of sealing assembly (e.g., sealing elements and props) can be included on a single packer 100, 200. It is contemplated that any suitable actuation scheme to actuate the packer between the sealed and unsealed state can be employed as is appreciated by those skilled in the art (e.g., hydraulic actuation, electrical actuation, mechanical actuation).

In accordance with an aspect of this disclosure, a method for setting a well packer can include propping an upward sealing element or an upward portion of a single sealing element to create a first propped seal point and propping a downward sealing element or a downward portion of the single sealing element to create a second propped seal point.

As described hereinabove, dual propped sealing elements create more stored element pressure for a given amount of setting force than the conventional element system (e.g., by reducing a contact area of the seal). In this regard, a seal can be set with higher sealing pressure or a seal can be fully set at traditional sealing pressures with less applied setting force.

ASPECTS

In accordance with at least one aspect of this disclosure, a packer for wells can include a body having a tubular shape, a sealing element having an upward end and a downward end and disposed around the body. The packer also includes a first prop upward of the sealing element, and a second prop downward of the sealing element. The first prop is configured to wedge under the upward end of the sealing element and the second prop is configured to wedge under the downward end of the sealing element to push the sealing element outward at both the upward end and the downward end.

In accordance with any embodiment or combination of embodiments disclosed above, the first prop can be formed as part of the body.

In accordance with any embodiment or combination of embodiments disclosed above, the second prop can be movable relative to the body to slide upward and wedge under the sealing element.

In accordance with any embodiment or combination of embodiments disclosed above, the second prop can be configured to push the sealing element up onto the first prop when wedging under the sealing element.

In accordance with any embodiment or combination of embodiments disclosed above, the packer can include a lower cover sleeve is slidably disposed around the second prop.

In accordance with any embodiment or combination of embodiments disclosed above, the lower cover sleeve can have a lower pushing face configured to push the sealing element upward to wedge the first prop under the upward end of the sealing element.

In accordance with any embodiment or combination of embodiments disclosed above, the packer can include an upper cover sleeve slidably disposed around the first prop and including an upper pushing face configured to limit upward movement of the sealing element after the first prop is wedged under the upper end of the sealing element.

In accordance with at least one aspect of this disclosure, a packer for a well includes a body having a tubular shape, an upper sealing element, a middle sealing element, and a lower sealing element disposed around the body, a first prop upward of the middle sealing element and downward of the upper sealing element, and a second prop downward of the middle sealing element and upward of the lower sealing element, wherein the first prop is configured to wedge under the upper sealing element to push the upper sealing element outward, wherein the second prop is configured to wedge under the lower sealing element to push the lower sealing element outward.

In accordance with any embodiment or combination of embodiments disclosed above, one or both of the first and second props can be configured to compress middle sealing element to outwardly expand the middle sealing element.

In accordance with any embodiment or combination of embodiments disclosed above, the first prop can include a flat downward surface.

In accordance with any embodiment or combination of embodiments disclosed above, the second prop can include a flat upward surface.

In accordance with any embodiment or combination of embodiments disclosed above, the packer can include an upper anti-extrusion ring disposed upward of the upper sealing element and configured to resist and/or prevent upper axial extrusion of the upper sealing element.

In accordance with any embodiment or combination of embodiments disclosed above, the packer can include a lower anti-extrusion ring disposed downward of the lower sealing element and configured to resist and/or prevent lower axial extrusion of the lower sealing element.

In accordance with any embodiment or combination of embodiments disclosed above, the anti-extrusion ring can include-a non-metal or metal material.

In accordance with any embodiment or combination of embodiments disclosed above, the first and/or second prop can include a metal.

In accordance with any embodiment or combination of embodiments disclosed above, the sealing element can include an elastic material.

In accordance with any embodiment or combination of embodiments disclosed above, the packer can include an upper and/or lower backup ring disposed outwardly adjacent the upper sealing element and/or lower sealing element, respectively.

In accordance with any embodiment or combination of embodiments disclosed above, the upper and/or lower backup ring can include at least one of Teflon, wire mesh, thermal-plastic, or other non-metallic material.

In accordance with any embodiment or combination of embodiments disclosed above, the packer can include an upper and/or lower support shoe disposed outwardly adjacent the upper and/or lower backup ring, respectively.

In accordance with any embodiment or combination of embodiments disclosed above, the upper and/or lower support shoe can include metal.

In accordance with any embodiment or combination of embodiments disclosed above, the packer can include an upper cone slidably disposed around the body and an upper slip, wherein the upper cone is configured move upward to outwardly deploy the upper slip.

In accordance with any embodiment or combination of embodiments disclosed above, the upper cone includes an upper pushing face configured to limit upward movement of the upper sealing element.

In accordance with any embodiment or combination of embodiments disclosed above, the packer can include a lower cone slidably disposed around the body and a lower slip, wherein the lower cone is configured move upward to push against the lower sealing element or the lower anti-extrusion ring, wherein the lower slip is configured to move upward relative to the lower cone to be outwardly deployed.

In accordance with any embodiment or combination of embodiments disclosed above, a method for setting a well packer can include propping an upward sealing element or an upward portion of a single sealing element to create a first propped seal point and propping a downward sealing element or a downward portion of the single sealing element to create a second propped seal point.

The methods and systems of the present disclosure, as described above and shown in the drawings, provide for improved well packers with superior properties including dual propped sealing elements. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A packer for a well, comprising:

a body having a tubular shape;

an upper sealing element, a middle sealing element, and a lower sealing element disposed around the body;

a first prop upward of the middle sealing element and downward of the upper sealing element; and a second prop downward of the middle sealing element and upward of the lower sealing element, wherein the first prop is configured to wedge under the upper sealing element to push the upper sealing element outward, and wherein the second prop is configured to wedge under the lower sealing element to push the lower sealing element outward.

2. The packer of claim 1, wherein one or both of the first and second props are configured to compress the middle sealing element to outwardly expand the middle sealing element.

3. The packer of claim 2, wherein the first prop includes a flat downward surface.

4. The packer of claim 2, wherein the second prop include a flat upward surface.

5. The packer of claim 2, wherein the first prop includes a flat downward surface and the second prop includes a flat upward surface, and further comprising:

an upper anti-extrusion ring disposed upward of the upper sealing element and configured to resist and/or prevent upper axial extrusion of the upper sealing element, and a lower anti-extrusion ring disposed downward of the lower sealing element and configured to resist and/or prevent lower axial extrusion of the lower sealing element.

6. The packer of claim 5, further comprising an upper cone slidably disposed around the body and an upper slip, wherein the upper cone is configured move upward to outwardly deploy the upper slip.

7. The packer of claim 6, wherein the upper cone includes an upper pushing face configured to limit upward movement of the upper sealing element.

8. The packer of claim 7, further comprising a lower cone slidably disposed around the body and a lower slip, wherein the lower cone is configured move upward to push against the lower sealing element or the lower anti-extrusion ring, wherein the lower slip is configured to move upward relative to the lower cone to be outwardly deployed.

9. The packer of claim 1, further comprising an upper anti-extrusion ring disposed upward of the upper sealing element and configured to resist and/or prevent upper axial extrusion of the upper sealing element.

10. The packer of claim 1, further comprising a lower anti-extrusion ring disposed downward of the lower sealing element and configured to resist and/or prevent lower axial extrusion of the lower sealing element.

11. The packer of claim 10, wherein the lower anti-extrusion ring includes a plastic, non-metallic or metal material.

12. The packer of claim 1, wherein the first and/or second prop includes plastic or metal material.

13. The packer of claim 1, wherein the upper sealing element includes an elastic material.

14. The packer of claim 1, further comprising an upper and/or lower backup ring disposed outwardly adjacent the upper sealing element and/or lower sealing element, respectively.

15. The packer of claim 14, wherein the upper and/or lower backup ring includes at least one of Teflon, wire mesh, thermal-plastic or other non-metallic material.

16. The packer of claim 14, further comprising an upper and/or lower support shoe disposed outwardly adjacent the upper and/or lower backup ring, respectively.

17. The packer of claim 16, wherein the upper and/or lower support shoe includes metal.

18. The packer of claim 1, further comprising an upper cone slidably disposed around the body and an upper slip, wherein the upper cone is configured move upward to outwardly deploy the upper slip.

19. The packer of claim 18, wherein the upper cone includes an upper pushing face configured to limit upward movement of the upper sealing element.

20. The packer of claim 1, further comprising a lower cone slidably disposed around the body and a lower slip, wherein the lower cone is configured move upward to push against the lower sealing element or the lower anti-extrusion ring, wherein the lower slip is configured to move upward relative to the lower cone to be outwardly deployed.

21. The packer of claim 1, wherein the middle sealing element includes an elastic material.

22. The packer of claim 1, wherein the lower sealing element includes an elastic material.

23. The packer of claim 9, wherein the upper anti-extrusion ring includes a plastic, non-metallic or metal material.

* * * * *